United States Patent [19]

Mori

[11] 4,435,906

[45] Mar. 13, 1984

[54] PERFORATING JIG

[75] Inventor: Chuzo Mori, Tokyo, Japan

[73] Assignee: Carl Manufacturing Co., Ltd., Tokyo, Japan

[21] Appl. No.: 343,168

[22] Filed: Jan. 27, 1982

[30] Foreign Application Priority Data

Jun. 26, 1981 [JP] Japan ..... 56-95020[U]

[51] Int. Cl.[3] ..... B26D 5/00; B27B 5/00

[52] U.S. Cl. ..... 33/185 R; 33/DIG. 1; 83/454; 83/743

[58] Field of Search ..... 33/174 B, 174 G, 180 R, 33/184.6, 185 R, DIG. 1; 83/454, 743, 744, 745, 83/821

[56] References Cited

U.S. PATENT DOCUMENTS

| | | | |
|---|---|---|---|
| 561,859 | 6/1896 | Boynton | 33/184.6 |
| 2,693,035 | 11/1954 | Beck | 33/174 B |
| 3,201,874 | 8/1965 | Christy | 33/180 R |
| 3,557,463 | 1/1971 | Perry et al. | 33/174 B |
| 3,846,915 | 11/1974 | Obermark et al. | 33/174 B |
| 4,060,333 | 11/1977 | White | 83/454 |
| 4,131,040 | 12/1978 | Bollmer | 83/743 |
| 4,361,964 | 12/1982 | Hennessee | 33/174 G |

*Primary Examiner*—Richard R. Stearns

*Attorney, Agent, or Firm*—Parkhurst & Oliff

[57] ABSTRACT

A perforating jig assists a punch in perforating cards or sheets for insertion into a loose-leaf notebook or ring binder. The perforating jig comprises a folded plate body or two superimposed plates having in a folded or joined edge thereof a plurality of recesses or notches in which a front perforating end of the punch can be fitted. A card or sheet which it is desired to perforate is inserted between the two plates until an edge of the card or sheet is exposed through the recesses. Then, the perforating end of the punch is inserted into the recesses in turn to perforate the card exposed in the recesses.

5 Claims, 9 Drawing Figures

PERFORATING JIG

BACKGROUND OF THE INVENTION

The present invention relates to a perforating jig for perforating cards or sheets of paper for insertion into loose-leaf notebooks or ring binders.

Loose-leaf notebooks or ring binders are designed to carry leaves of paper prepared for use therein. Account books of the loose-leaf type have a similar design. Heretofore, one who has a loose-leaf notebook is required to purchase commercially available spare sheets of paper which have already been perforated to suit that particular loose-leaf notebook. However, there has recently been a trend among students, researchers and others to use large-sized cards, usually about 128×182 mm in size, instead of conventional notebooks or for maintaining information collected on paper. Perforated cards of that size (having perforations at 8 cm intervals) have been on the market. Relatively thick unperforated cards have also been offered for sale, which purchasers oftentimes find it necessary to put in a loose-leaf notebook or ring binder.

Unperforated cards or sheets of paper can be perforated by being folded into a two-ply structure and then by being pierced on a punch with the center of the folded sheet being aligned with a central positioning mark on the punch. Relatively thick cards or sheets cannot be folded neatly with ease, and to fold such thick cards or sheets is not desirable. It is tedious and time-consuming to perforate such thick cards or sheets when only a one-hole perforating punch is at hand.

U.S. Pat. No. 3,172,325 discloses one known device for making a plurality of holes through unperforated cards or sheets for insertion in ring binders. The disclosed perforating device comprises upper and lower metal plates coupled with each other by a hinge, the lower metal plate having one or more punch projections and the upper metal plate having corresponding openings for mating with the punch projections. When in use, a sheet or card to be perforated is inserted between the upper and lower metal plates, and the upper metal plate is moved toward the lower metal plate. As the punch projections on the lower metal plate pass into the openings in the upper metal plate, the sheet will be perforated.

With the prior perforating device, a large amount of force would have to be exerted to push the upper metal plate down toward the lower metal plate when perforating a thick card or sheet of paper, so that the perforating task has been quite laborious.

SUMMARY OF THE INVENTION

It is a primary object of the present invention to provide a perforating jig for perforating unperforated cards or sheets for insertion into loose-leaf notebooks or ring binders.

Another object of the present invention is to provide a perforating jig for perforating cards or sheets of a relatively large thickness with a plurality of holes by means of a perforating punch such as a one-hole perforating punch in a simple operation.

A perforating jig according to the present invention is in the form of two superimposed plates, one edge thereof being openably and closably joined, for sandwiching a card or sheet of paper, the folded plate body having in and along its folded edge recesses or notches in which a front end portion of a perforating punch can be fitted in abutting relation to the bottom of the recess. The perforating jig may be composed of a single folded plate body or two separate plates with a liner interposed therebetween along a marginal edge thereof so as to form substantially two-ply plate. For reliable retention of a card or sheet therebetween, folded or substantially folded plates may be provided with magnetic plates attached in corresponding positions to confronting surfaces thereof. The recesses may be provided in plurality which are dimensioned to allow the front end portions of the punch to be bodily fitted therein. Alternatively, one or more recesses may be defined in the folded edge which are of such a contour that the front end portion of the punch can be held at a side thereof against one of the corners of the recess.

The above and other objects, features and advantages of the present invention will become more apparent from the following description when taken in conjunction with the accompanying drawings in which certain preferred embodiments are shown by way of illustrative example.

DETAILED DESCRIPTION OF THE PREFERRED EMBODIMENTS

Figure 1:
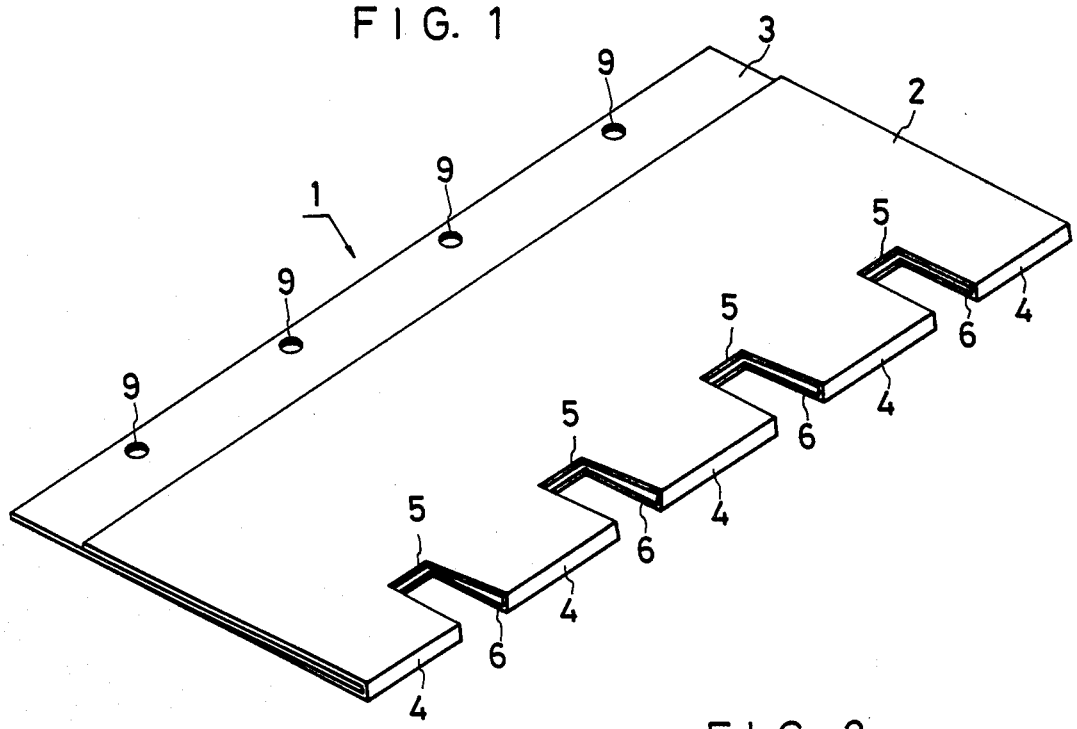
FIG. 1 is a perspective view of a perforating jig according to an embodiment of the present invention.

As shown in FIG. 1, a perforating jig 1 comprises an upper plate 2 and a lower plate 3 made of a single plate body folded on itself with one marginal edge terminating short of a corresponding opposite marginal edge. The perforating jig 1 has a plurality of stops 4 defined in a folded edge thereof and spaced regular intervals from each other for abutting engagement with a card or sheet of paper inserted and sandwiched between the upper and lower plates 2, 3 for being held. The stops 4 are of such a height as to be selected according to cards or sheets which it is desired to perforate.

Figure 2:
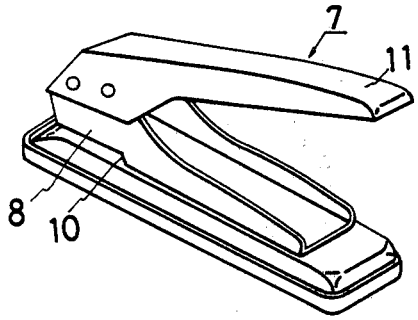
FIG. 2 is a perspective view of a perforating punch for use with the perforating jig.

The upper and lower plates 2, 3 have aligned recesses or notches 5, 6, respectively, defined in the folded edge and extending toward the marginal edges, the recesses 5, 6 being disposed between adjacent stops 4. The recesses 5, 6 are dimensioned such that a front end portion 8 of a perforating punch 7 (FIG. 2) can fit snugly therein in abutment against the bottom of the recesses 5, 6. When a card or sheet to be punched through is inserted in position between the upper and lower plates 2, 3, edge portions of the sheet are left exposed through the recesses 5, 6 so that the exposed portions of the sheet can be perforated by the punch 7.

The marginal edge of the lower plate 3 which is remote from the folded edge has a plurality of holes 9 for insertion therethrough of rings of a ring binder (not shown) to hold the perforating jig 1 in the ring binder. Therefore, when the perforating jig 1 is not in use, it may be left installed in the ring binder. When the perforating jig 1 is to be used, it may be removed from the binder for use with the perforating punch 7 to perforate a sheet or card.

Figure 3:
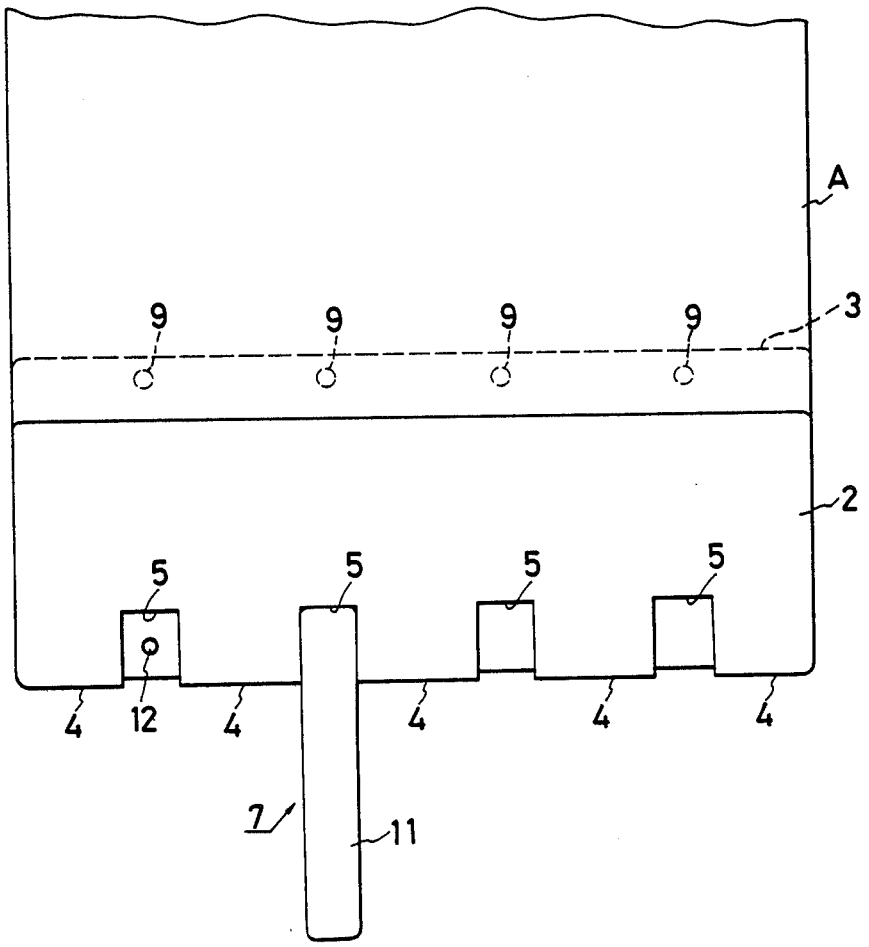
FIG. 3 is a plan view showing the way in which the perforating jig shown in FIG. 1 is used.

To perforate a card or sheet with the aid of the perforating jig 1, as shown in FIG. 3, the card A or a paper sheet is inserted between the upper and lower plates 2, 3 until an edge of the card A is brought into abutting engagement with the stops 4.

The edge of the card A as exposed through the recesses 5, 6 is perforated successively from the left to the right in the drawing, for example, as illustrated in FIG. 3. More specifically, an exposed edge portion of the card A is inserted into a slot 10 (FIG. 2) in the punch 7 as the front end portion 8 thereof is positioned by being fitted into the recesses 5, 6. Then, a lever 11 of the punch 7 is depressed to cause a punch projection (not shown) on the punch to perforate the exposed edge portion of the card A to define a hole 12 (FIG. 3) therethrough. The front end portion 8 of the punch 7 is now removed out of the first recesses 5, 6 and then inserted into adjacent recesses 5, 6 for perforating an exposed edge portion of the card A therein in the same manner as described above. The card A is thus perforated from the left to the right (FIG. 3) with as many as holes as there are recesses 5, 6.

Figure 4:
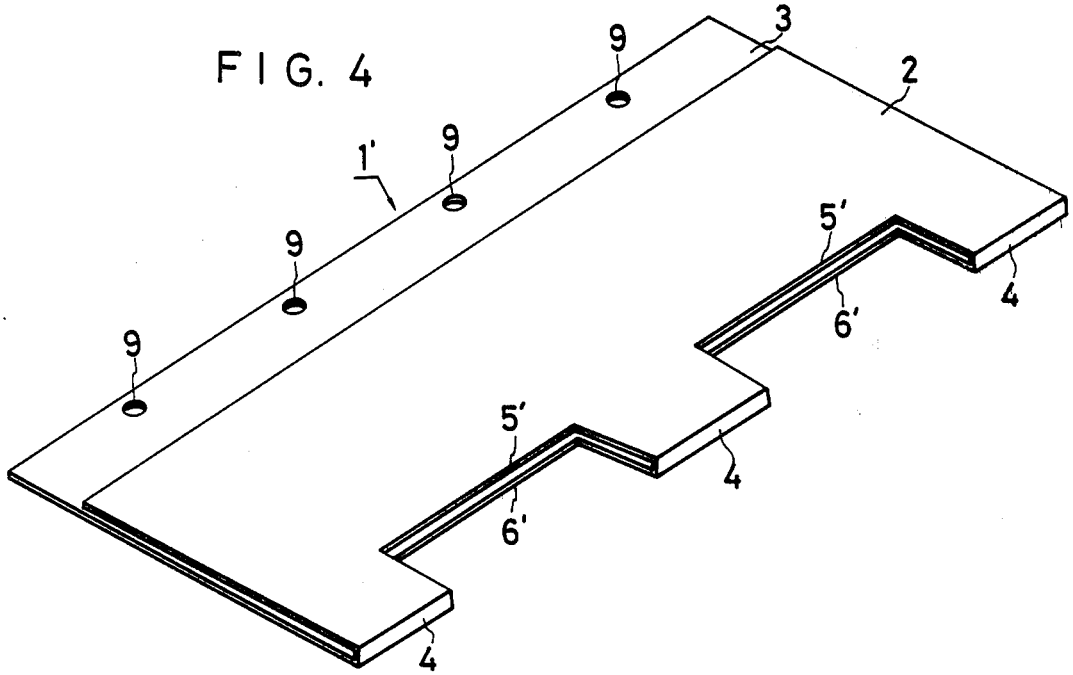
FIG. 4 is a perspective view of a perforating jig according to another embodiment of the present invention.
Figure 5:
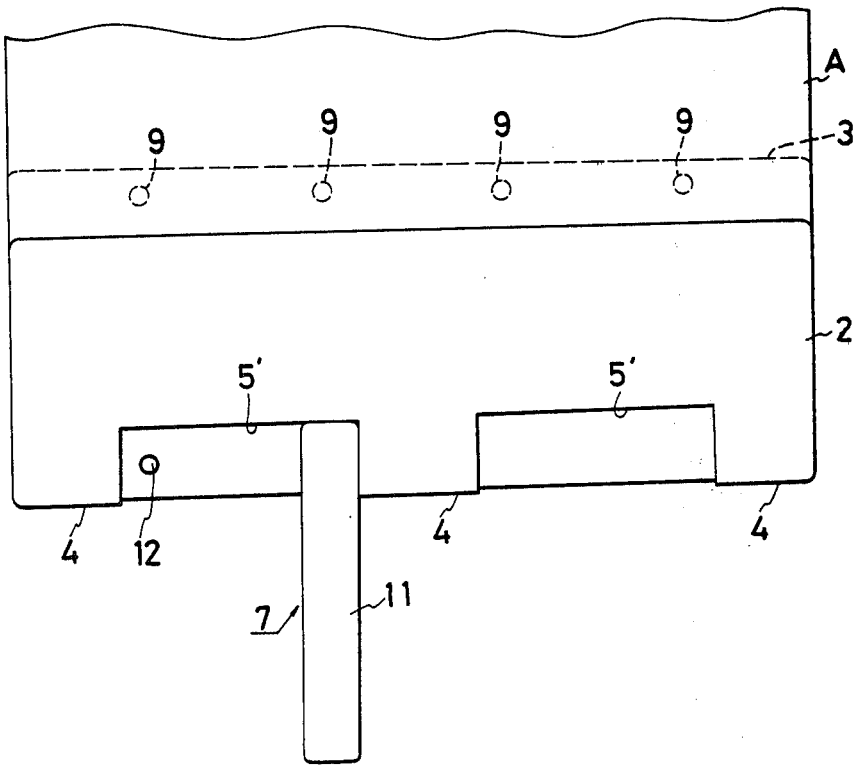
FIG. 5 is a plan view showing the manner in which the perforating jig of FIG. 4 is used.

FIG. 4 illustrates a perforating jig according to another embodiment of the present invention. Identical parts are denoted by identical reference characters in FIGS. 1 and 4. The perforating jig 1' has recesses 5', 6' which are elongated along the folded edge of the upper and lower plates 2, 3. The punch 7 can be positioned with respect to the perforating jig 1' by holding a side of the front end portion 8 of the punch 7 snugly against one of opposite corners of the recesses 5', 6' as shown in FIG. 5, whereupon the punch 7 can be actuated to perforate a card or sheet A where it is exposed through the recesses 5', 6'.

In operation, the card A is placed between the upper and lower plates 2, 3 with one edge of the card A being held against the stops 4, and exposed edge portions are perforated by the punch 7 successively from the left to the right. During perforation of the card A, the front end portion 8 of the punch 7 with its slot 10 receiving the exposed edge portion of the card A is positioned at one of the corners of the recesses 5, 6.

Figure 6:
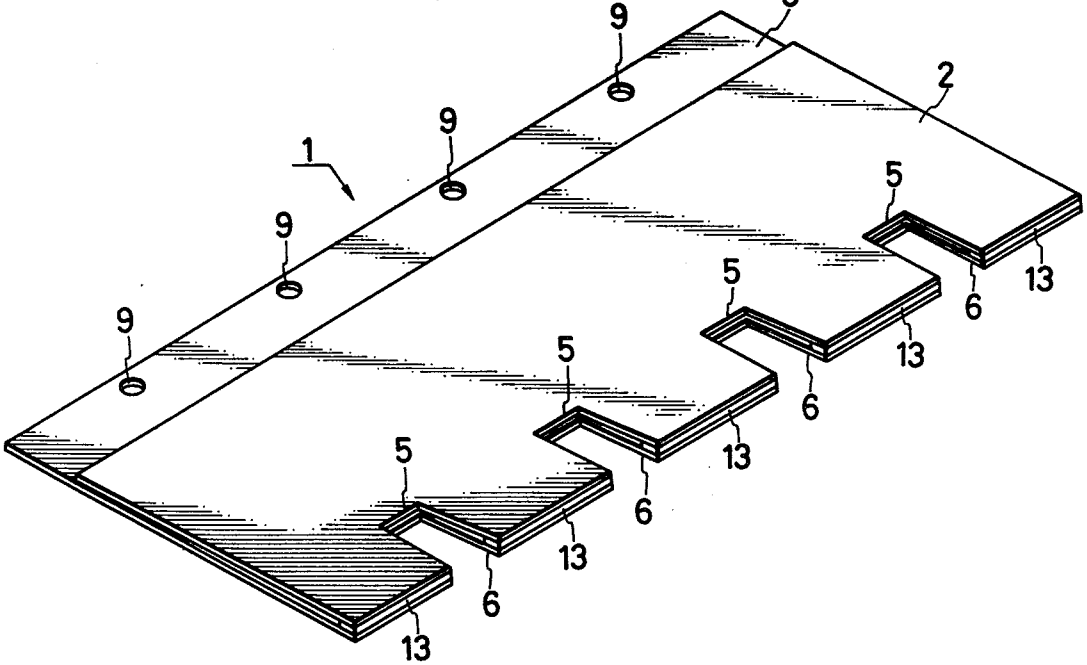
FIG. 6 is a perspective view of a perforating jig according to another embodiment of the present invention.
Figure 7:
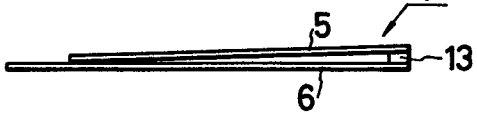
FIG. 7 is a side view of the perforating jig of FIG. 6.

While in the illustrated embodiments the upper and lower plates 2, 3 and the stops 4 are made of a single plate body, they may be constructed respectively of two separate flat plates and a liner sandwiched and supported therebetween along a marginal edge thereof. As shown in FIG. 6 and FIG. 7, for example, the perforating jig may have such a structure that a liner is interposed between the edge portion of the upper plate 2 in which a plurality of recesses 5 are provided and the edge portion of the lower plate 3 in which a plurality of recesses 6 are formed, allowing free opening and closing of the upper plate 2 and the lower plate 3 with fulcruming by the liner 13. In the perforating jig, the liner 13 acts as a stopper to receive an edge portion of the sheet of paper inserted between the upper plate 2 and the lower plate 3.

Figure 8:
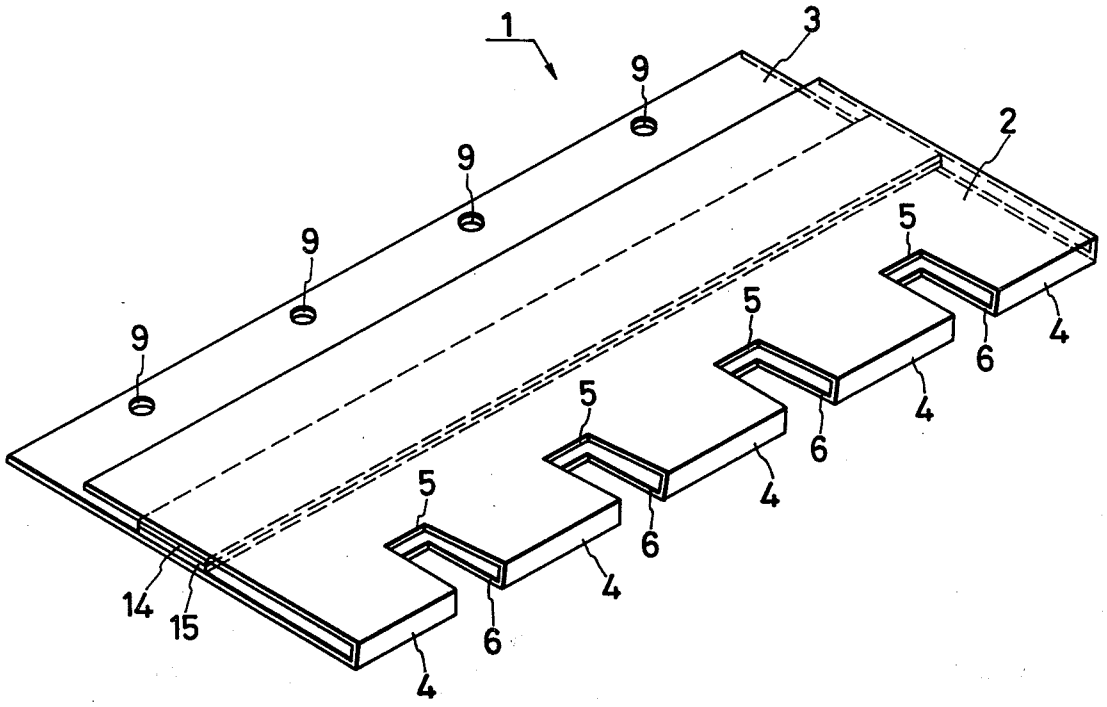
FIG. 8 is a perspective view of a perforating jig according to another embodiment of the present invention.
Figure 9:
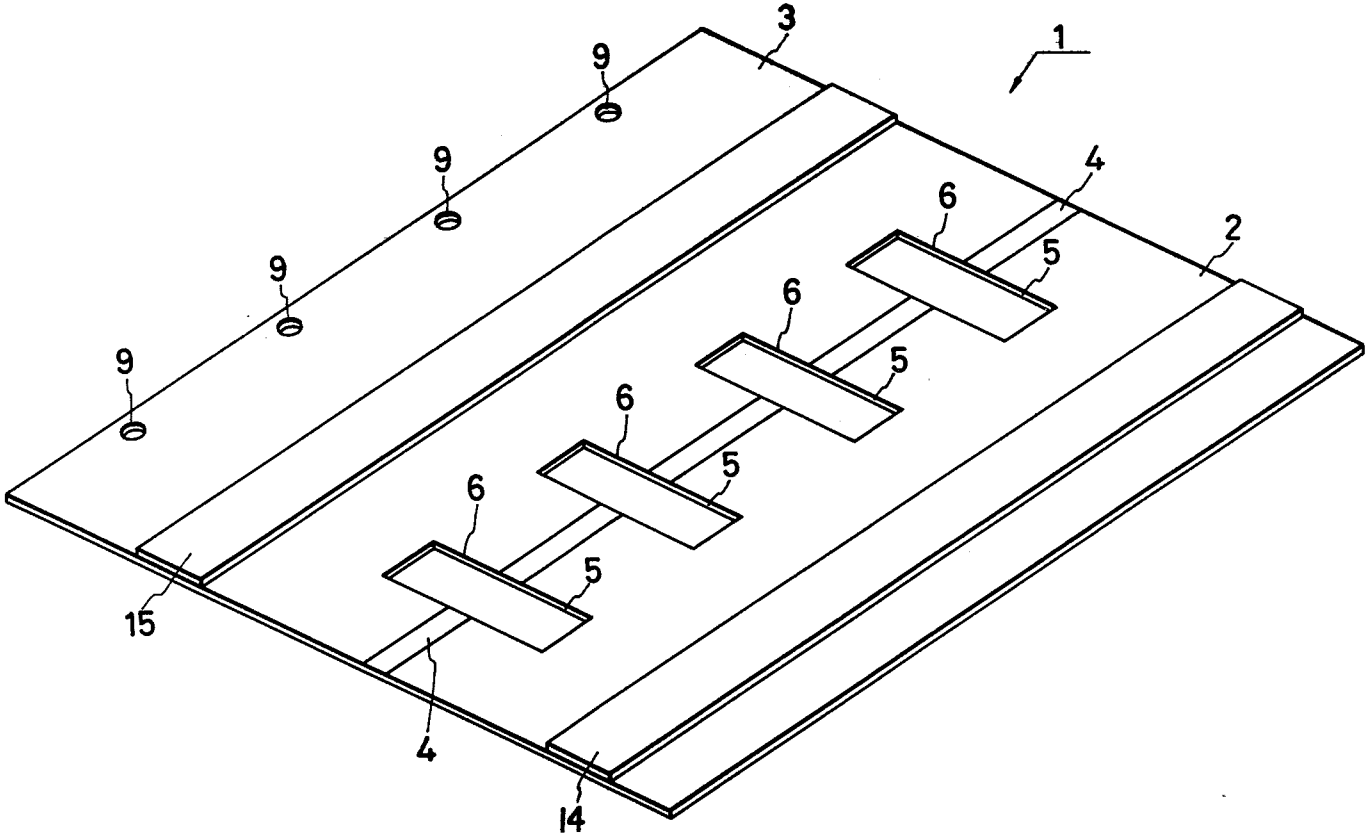
FIG. 9 is a perspective view showing a state where an upper plate and a lower plate of the perforating jig of FIG. 8 are opened.

The upper and lower plates 2, 3 may be provided with as many recesses 5, 6 or 5', 6' as desired, and the stops 4 may be spaced from one another by desired intervals, dependent on the number of and distances between holes to be formed in cards or sheets. Furthermore, in this invention, the upper and lower plates 2, 3 may be provided with magnetic plates attached correspondingly to confronting surfaces thereof to retain a card or sheet reliably therebetween. As shown in FIG. 8 and FIG. 9, for example, in the perforating jig, the upper plate 2 may be provided with a magnetic plate 14 at the surface confronting that of the lower plate 3 when the upper plate 2 and the lower plate 3 are superimposed, while the lower plate 3 is provided with a magnetic plate 15 at the surface confronting that of the upper plate 3. By operation of the magnetic plates 14, 15, the present invention provides such a structure that a sheet of paper, etc. inserted between the upper plate 2 and lower plate 3 can be reliably retained.

With the perforating jig 1 or 1' of the present invention, cards or sheets can be perforated with utmost ease for insertion into loose-leaf notebooks or ring binders.

Although certain preferred embodiments have been shown and described in detail, it should be understood that many changes and modifications may be made therein without departing from the scope of the appended claims.

What is claimed is:

1. A perforating jig comprising two superimposed plates, one edge thereof being openably and closably joined, for sandwiching a sheet therebetween, said plates having in and along the joined edge at least one recess in each plate so formed as to allow insertion and positioning therein of a perforating end of a punch to fully perforate an edge portion of the sheet.

2. A perforating jig according to claim 1, said two superimposed plates being made of a single plate body folded on itself into a substantially two-ply plate, said joined edge comprising a fold of said folded plate body.

3. A perforating jig according to claim 1, said two superimposed plates being separate from each other, including a liner interposed between said separate plates and defining said joined edge.

4. A perforating jig according to claim 1, said two superimposed plates being so constructed as to be openable and closable, including magnetic plates in corresponding positions on confronting surfaces of said two superimposed plates.

5. A perforating jig according to claim 1, each of said recesses being elongate along said joined edge so that the perforating end of the punch as received in the recess can be held at a side against one corner of the recess.

* * * * *